US006830401B1

(12) United States Patent
Hwang et al.

(10) Patent No.: US 6,830,401 B1
(45) Date of Patent: Dec. 14, 2004

(54) MECHANICAL ARCHITECTURE FOR PRINTER TRAYS

(75) Inventors: Pete Hwang, Vancouver, WA (US); Michael Janczyk, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/658,323

(22) Filed: Sep. 10, 2003

(51) Int. Cl.[7] ..... B41J 29/02

(52) U.S. Cl. ..... 400/693; 400/718; 347/8; 347/16; 347/108; 347/104

(58) Field of Search ..... 400/693, 718; 347/108, 104, 16, 8

(56) References Cited

U.S. PATENT DOCUMENTS 5,534,989 A 7/1996 Rubscha et al.
5,746,526 A * 5/1998 Hirose ..... 400/619
5,838,338 A 11/1998 Olson
5,967,677 A 10/1999 McCue, Jr. et al.
6,102,509 A 8/2000 Olson
6,132,122 A * 10/2000 Robinson et al. ..... 400/624
6,386,663 B1 * 5/2002 Olson ..... 347/8
2003/0052956 A1 * 3/2003 Katsuyama ..... 347/108

* cited by examiner

*Primary Examiner*—Andrew H. Hirshfeld
*Assistant Examiner*—Marissa Ferguson

(57) ABSTRACT

A printer including an input tray including a input print media support surface and an output tray including an output print media support surface separate from the input print media support surface of the input tray, wherein the output tray nests in the input tray or the input tray nests in the output tray when the input tray and the output tray are in the closed position, and wherein the input tray is configured to prevent input print media in the input tray that has not been circulated through the printer from contacting output print media in the output tray that has been circulated through the printer.

56 Claims, 13 Drawing Sheets

MECHANICAL ARCHITECTURE FOR PRINTER TRAYS

BACKGROUND OF THE INVENTION

Printers have become ubiquitous in office and home environments. Some common applications are for desktop printing of computer generated documents. Prior art printer architectures are not designed for minimizing a printer foot print when the printer is positioned on a desk or other support structure. Further, prior art printer architectures are not designed for minimizing shipping volume.

It would be an advantage to provide a printer with low foot print and/or a small footprint and/or a printer that minimizes a volume needed for shipping and/or while providing media trays of substantial strength.

DETAILED DESCRIPTION OF THE EXEMPLARY EMBODIMENTS

Figure 1:
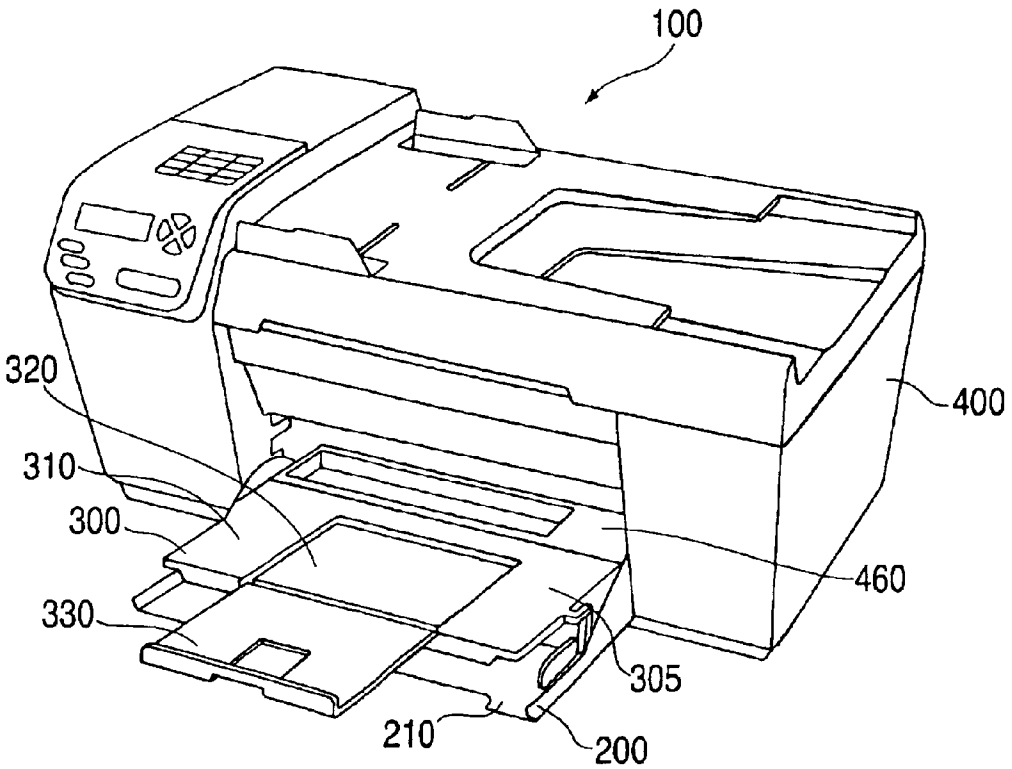
FIG. 1 shows a printer according to a first embodiment of the invention.

Reference will now be made in detail to various embodiments of the present invention. An effort has been made to use the same reference numbers throughout the drawings to refer to the same or like parts. Directional and spatial language, such as upwards and bottom, is frequently used herein. This language for the exemplary embodiments is intended to be interpreted in view of a printer sitting on a table and ready to print, where the printer is in a fully deployed configuration.

In a first embodiment of the present invention, as seen in FIGS. 1–13, there is a printer 100 comprising an input tray 200 and an output tray 300. In some embodiments of the invention, these trays are full input trays and full output trays, while in others, these trays are not full input trays and full output trays. By "full input tray" and "full output tray," it is meant trays for a printer that support print media used in a printer in a manner that prevents pre-printed media in one tray from contacting printed media in another tray, based on the print media size that is to be typically utilized in the printer. That is, a full input tray prevents input media (e.g. paper that has not been circulated through the printer) in a full input tray from contacting output media (e.g. paper that has circulated through the printer) in the output tray, and visa-versa. (Of course, this does not include trays that prevent a piece of print media from contacting the media on the input tray and the output tray while the piece of print media is circulating through the printer, since in some printers, the top of the print media can be in the output tray while the bottom of the media can still be in the input tray.) Full trays can be differentiated from trays formed from, for example, a stub that only supports a small portion of the surface area of print media, which, in the case of an input tray positioned below the output tray, permit at least some of the unsupported portions of output media (e.g. portions not in contact with the stub) to contact the input media.

The input tray 200 and the output tray 300 can include respective input and output print media support surfaces 210 and 310. In the first embodiment of the present invention, the support surfaces 210 and 310 are configured to support an entire piece of print media having dimensions 8½ inches by 11 inches, such as a conventional standard size paper and/or A4 paper. In some embodiments of the invention, the support surface 310 includes a surface formed by extending the output stop 330 (discussed in greater detail below) while in other embodiments, the support surface 310 does not include a surface formed by extending the output stop 330. In other embodiments of the present invention, the support surfaces 210 and 310 only support a portion of a piece of print media having dimensions 8½ inches by 11 inches. In some embodiments of the present invention, the support surfaces are flat, while in other embodiments of the present invention, the support surfaces are curved. Still further, in other embodiments of the present invention, the support surfaces have cavities where a portion of the print media is not supported. By way of example only and not by limitation, the cavity 320 for the output stop 330 of the output tray 300 (discussed in greater detail below) could result in portions of the output print media not being supported by the output print media support surfaces 310. This could also be the case with the input print media support surface 210.

Figure 10:
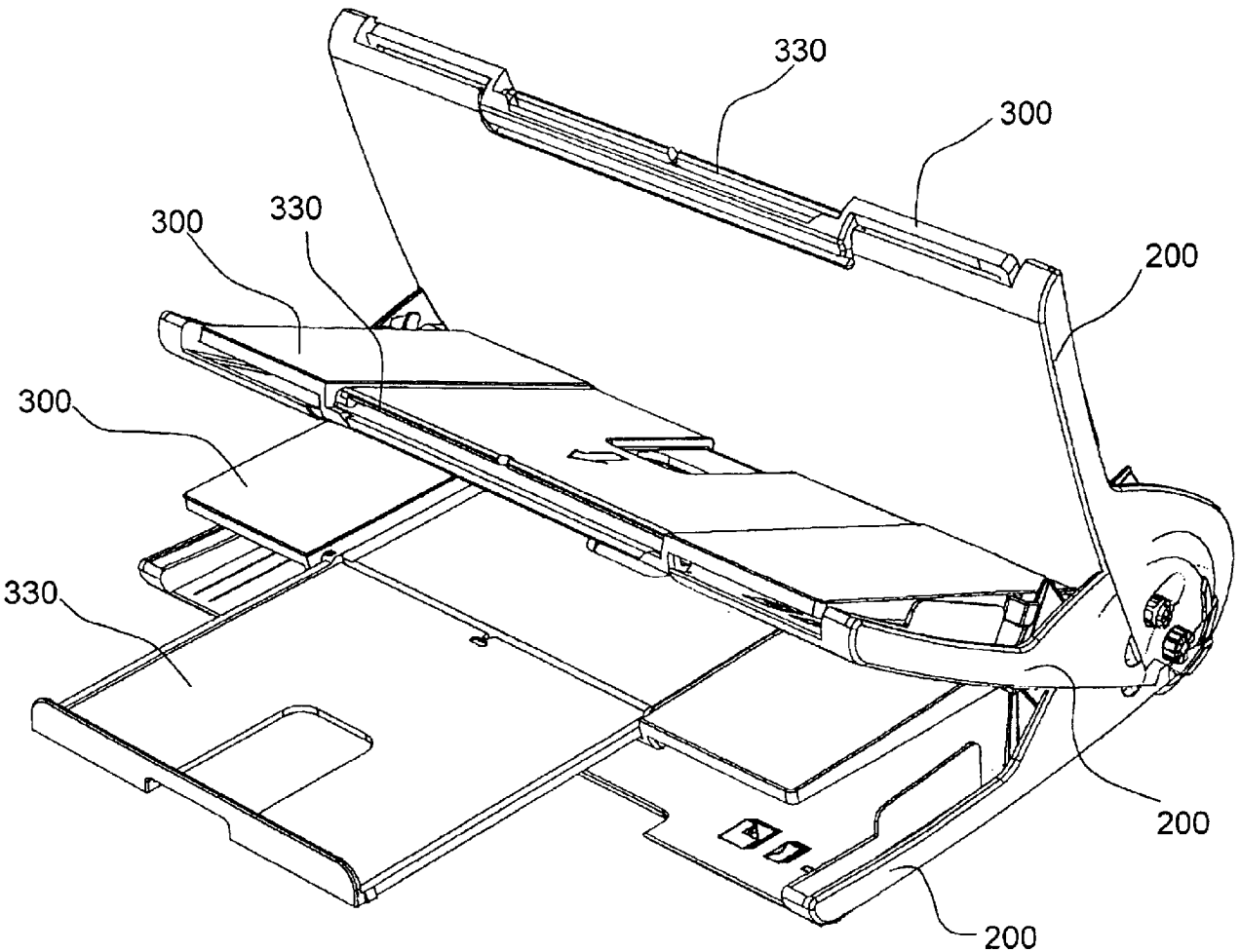
FIG. 10 shows an isometric view showing movement of the trays of the printer of FIG. 1.

According to the first embodiment of the present invention, the input tray 200 and the output tray 300 can be configured to rotate from a open position to a closed position. FIG. 10 illustrates rotation of the trays of an embodiment of the present invention from the open position to the closed position. However, in other embodiments of the present invention, the trays 200 and 300 can be open and closed in a different manner. In this regard, some embodiments of the present invention can be practiced by utilizing any means that will result in the opening and the closing of the trays of the printer.

Figure 2:
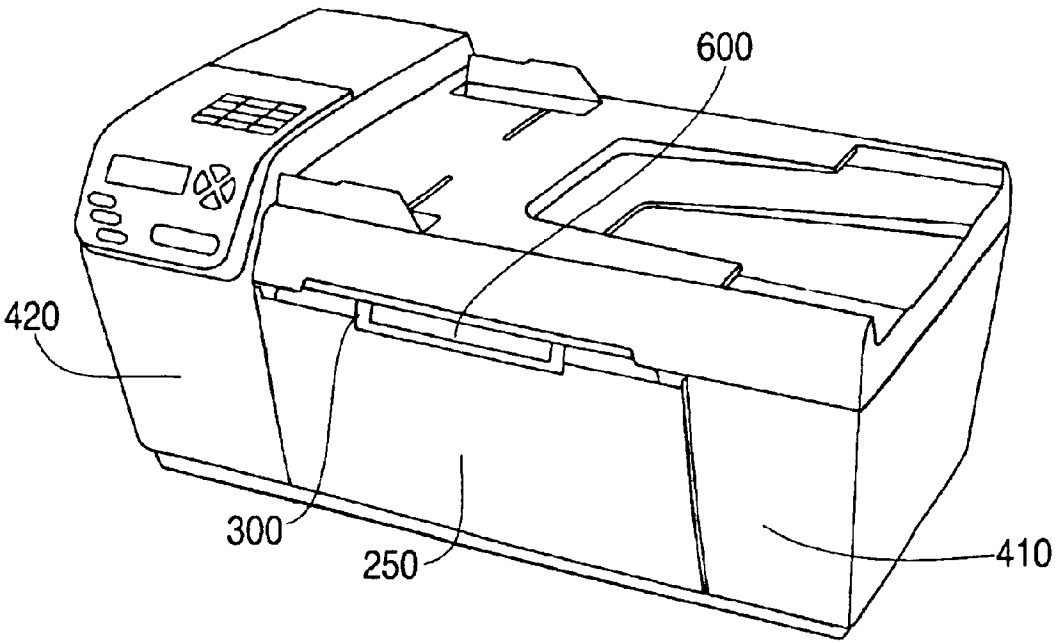
FIG. 2 shows the printer of FIG. 1 with the trays in the closed position.

In the first embodiment of the invention, the input print media support surface 210 of the input tray 200 is positioned outboard of the output print media support surface 310 of the output tray 300 (i.e., the input print media support surface 210 is positioned a distance further from the center of the printer 100 than the output print media support surface 310) when the input tray and the output tray are in the closed position, as shown in FIG. 2. In one embodiment of the present invention, this is a result of the rotation of the input tray 200 to the closed position, where the input tray 200 is positioned below the output tray 300 when the trays are in the open position, as shown in FIG. 1. However, it is noted that in other embodiments of the present invention, the output print media support surface 310 of the output tray 300 could be positioned outboard of the input print media support surface 210 of the input tray 200 when the input tray 200 and the output tray 300 are in a closed position. This could be the case, by way of example, when the input tray 200 is positioned above the output tray 300 when the trays are in the open position.

As can be seen from FIG. 2, the input tray 200 of the first embodiment forms part of an exterior side of the printer when the input tray 200 and the output tray 300 are in the closed position. In this embodiment, the input tray 200 is substantially contoured with the housing 400 of the printer when the trays are in the closed position, thus resulting in a printer 100 of a reduced footprint as well as a printer with a uniform appearance in that the trays generally conform to the overall shape of side of the printer.

Figure 13:
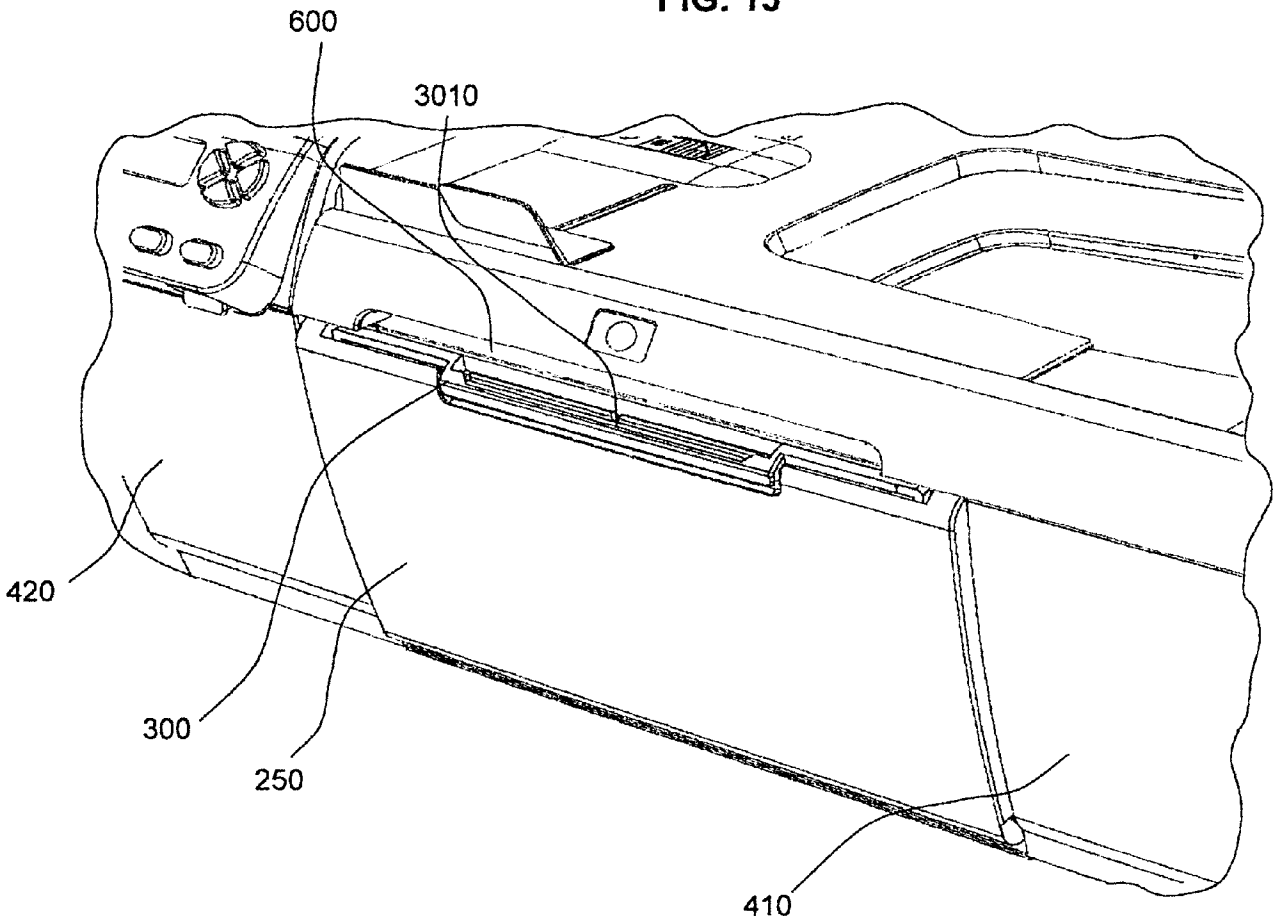
FIG. 13 shows a close-up view of the printer of FIG. 2.

By "substantially contoured," it is meant that the exterior (as in reference to trays in the closed position) side surface 250 of the input tray 200, as shown in FIG. 2 and FIG. 13, is contoured in about the same manner as the exterior surface 410 and/or 420 of the side of the printer housing 400 into which/out of which the trays rotate, and that when the trays are in the closed position, the exterior side surface of the input tray 200 is about aligned with the surface 410 and/or 420 of the side of the printer housing 400. Thus, there is minimal protrusion and/or intrusion of the input tray 200 from the printer housing 400 when the trays are in the closed position. However, a limited amount of protrusion/intrusion can be present in the embodiments and still obtain a substantially contoured configuration. In some embodiments of the present invention, the exterior side surface 250 of the input tray 200 protrudes about 4 mm from the exterior surface 410 and/or 420 of the printer housing. Still further, a limited amount of difference between the contours of the exterior surface 250 of the input tray and the surface 410 of the printer housing 400 can be present in the embodiments and still obtain a substantially contoured configuration. That is, the trays do not need to have the exact same contour as the contour of the exterior surface 410/420 of the printer housing, providing that the trays maintain a uniform finished look that is comparable to the context of at least one of the exterior surfaces of the printer housing 400. Still further by way of example there could be a prominent protrusion or indentation on one or more of the trays to, by way of example, to notify a user as to how to open or close the trays.

It is further noted that in the above explanation of the configuration of the side of the housing 400 into and out of which the trays rotate, the input tray 200 is located on the outboard side of the output tray 300. However, it is noted that the above explanation is applicable in a modified form as would be readily understood to one of ordinary skill in the art to embodiments where the output tray is on the outboard side of the input tray 200; the output tray 300 having an exterior surface that is substantially contoured with the surface 410 and/or 420 of the printer housing 400.

According to another embodiment of the present invention, the output tray 300 nests inside the input tray 200 (or visa-versa) when the input tray 200 and the output tray 200 are in a closed position. In such an embodiment, the printer 100 can utilizes a full input tray 200 including a print media support surface 210, and an output tray 300 with a support surface 310. It is noted that in some embodiments of the invention, the output tray 300 is not a full output tray as described above. It could include trays formed from a stub that only supports a small portion of the surface area of print media, where, in the case of an input tray positioned below the output fray, at least some of the unsupported portions of output media (e.g. portions not in contact with the stub) could come into contact with the input media supported by the input tray.

It is noted that in other embodiments of the present invention utilizing an input tray 200 and an output tray 300 that nests in the input tray 200 in the closed position, the output tray 300 is a full output tray 300 as described above. Again, it is noted that in other embodiments of the invention, the input tray 200 could nest in the output tray 300.

It is noted that other embodiments of the present invention can utilize a full output tray 300 that nests in a full input tray 200 when the output tray is in the closed position, and visa-versa.

Figure 3:
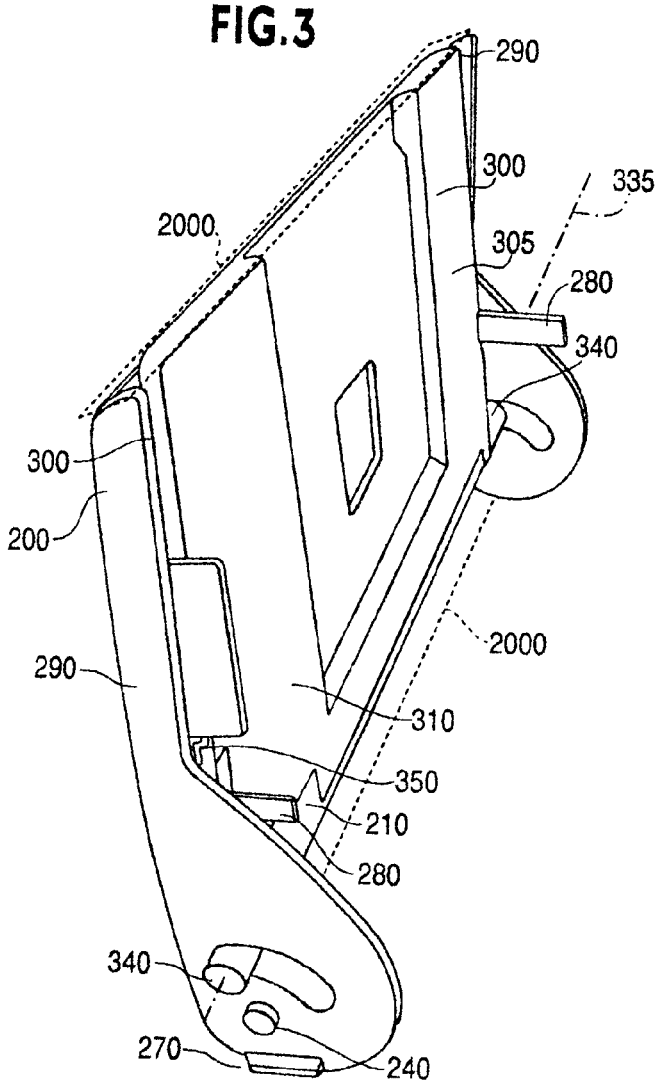
FIG. 3 shows the trays of the printer of FIG. 1
Figure 11:
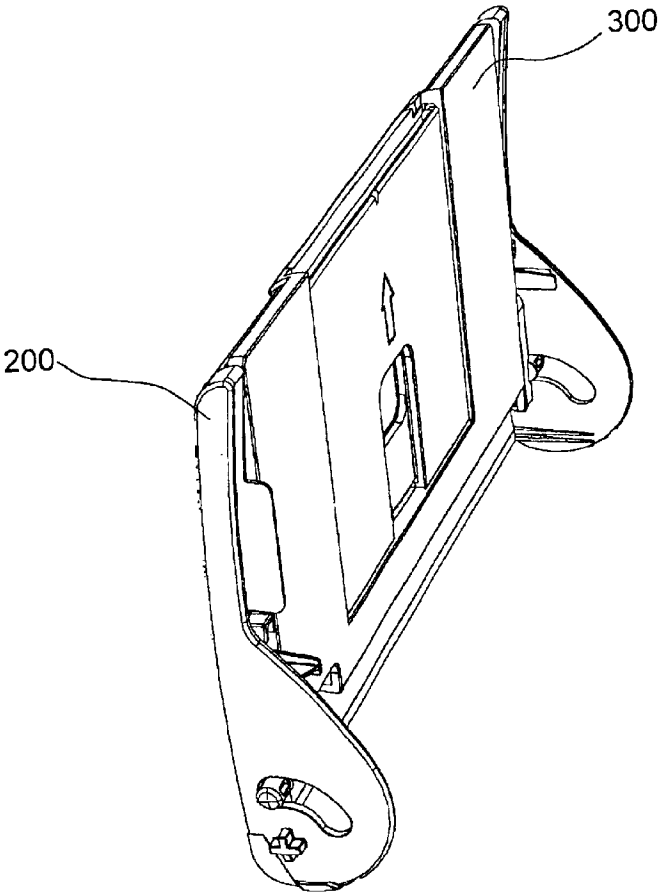
FIG. 11 shows another variation of the trays of FIG. 1 with the added feature of an arrow that provides visual instructions to a user.

By the term "nest," it is meant that at least a portion of one tray is seated inside at least a portion of another tray, as shown, by way of example, in FIG. 3 and/or in FIG. 11. FIG. 3 (showing the output tray 300 with output stops 330 removed for clarity and with the printer housing 400 removed for clarity) shows the configuration of the input tray 200 and an output tray 300 in the closed position. Support walls 290 extending from the input media support surface 210 extend past the output print media support surface 310. In the embodiment shown in FIG. 3, when looking down an axis of rotation 335 of the output tray 300 (discussed in greater detail below) a substantial portion of the output print media support surface 310 lies inside the sidewalls 290 of the input tray.

In other embodiments of the present invention, a substantial portion of the support surface 310 of the output tray 300 lies inside an extrapolated volume formed by the input print media support surface 210 of the input tray 200 and the support walls 290 of the input tray 200. By "extrapolated volume," it is meant an estimated volume that would be present if the ends of the support walls 290 on either side of the input tray 200 were connected by walls running about normal to both the support walls 290 and the input print media support surface 210 of the input tray 200, as shown by the dashed lines 2000 in FIG. 3. From FIG. 3, it can be seen that the output print media support surface 310 lies inside this extrapolated volume. It is noted that in other embodiments of the invention, the output print media support surface 310 can lie outside the extrapolated volume and the output tray would still be considered nested in the input tray if a substantial portion of the output tray 300 was positioned inside the extrapolated volume.

It is noted that the trays nest even though one portion of a tray extends past another portion of the tray, as seen, by way of example, in FIGS. 3 and 13, where a hinged portion 3010 of the output tray (discussed in greater detail below), extends through the input tray 200 when in the closed position.

Having explained some of the possible relationships between the input tray 200 and the output tray 300 of the present invention, additional features that can be present in some embodiments will now be discussed. It is noted that some or all of these additional features described below can be practiced with some or all of the embodiments of the present invention, as is the case with some or all of the above discussed features.

In one embodiment of the invention, when the input tray 200 and the output tray 300 are in the open position, the print media support surfaces 210 and 310 can be about 20 mm from each other; surface 210 being below surface 310. However, other embodiments of the present invention can have smaller distances or greater distances. By way of example, if 500 sheets of 8½×11 inch paper is desired to be placed in the input tray 200, the distance between the two surfaces could be larger.

As can be seen from FIG. 2, the printer 100 has a cavity 600. Cavity 600 permits the user to place his or her fingers in the cavity to impart an outward force (away from the printer 100 and with a component orthogonal to the surface 250) on the input tray 200 and/or the output tray 300, thus causing the trays to rotate towards the open position. It is noted that such a cavity can be present, or a variation or a plurality of variations of such a cavity can be present in the printer 100 of the present invention and still have an input tray 200 that is substantially contoured with the surface 410 of the side of the printer housing 400.

In one embodiment of the invention, shown in FIG. 3, an axis of rotation 335 of the output tray 300 is defined by rotation bosses 340 extending from the sides of the output tray 300. These rotation bosses 340 can be made as one piece with the main body 305 of the output tray 300 and can extend from the sides of the output tray 300.

Figure 4:
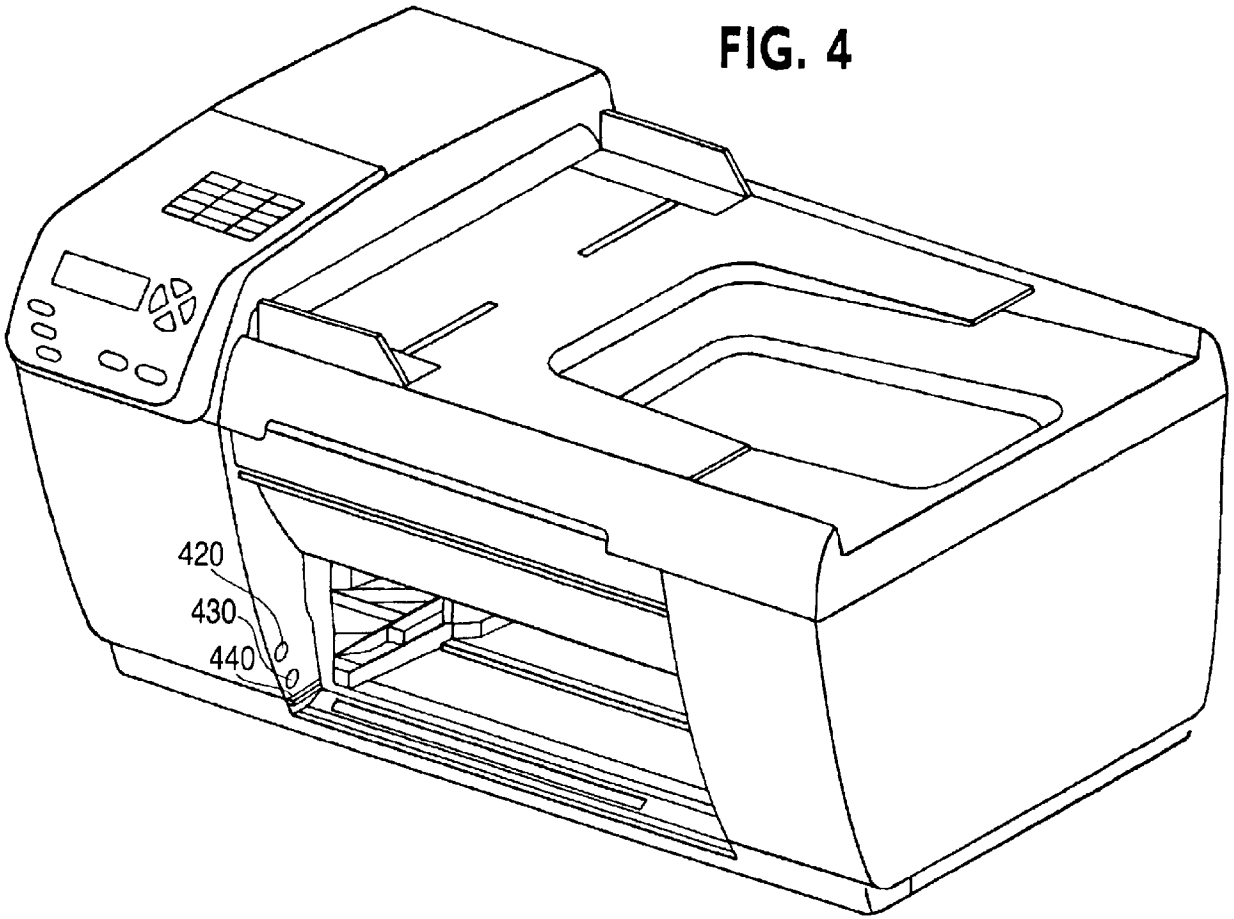
FIG. 4 shows the printer of FIG. 1 with components removed for clarity.

The rotation bosses 340 of the output tray 300 can fit into boss holes 420 (only one of which is shown in FIG. 4, which shows the housing 400 with the input tray 200 and the output tray 300 removed for clarity.) Thus, when the rotation bosses 340 are inserted into boss holes 420, the output tray 300 can rotate from the closed position to the open position and visa-versa.

To facilitate insertion of the rotation bosses 340 into the rotation boss holes 420, the output tray 300 can be provided with relief sections (not shown) behind one or more of the rotation bosses 340 that permit a respective rotation boss 340 to flex inward relative to the main body 305 of the output tray 300. In one embodiment of the present invention, these relief sections comprise sections that form an exaggerated "U" shape in the main body 305 of the output tray 300, where at least one of the legs of the "U" can be compressed towards the other leg.

In some embodiments of the present invention, the input tray 200 is of one-piece construction and is, by way of example, molded from plastic. However, other embodiments can utilize an input tray 200 that is of two or more piece construction.

Figure 5:
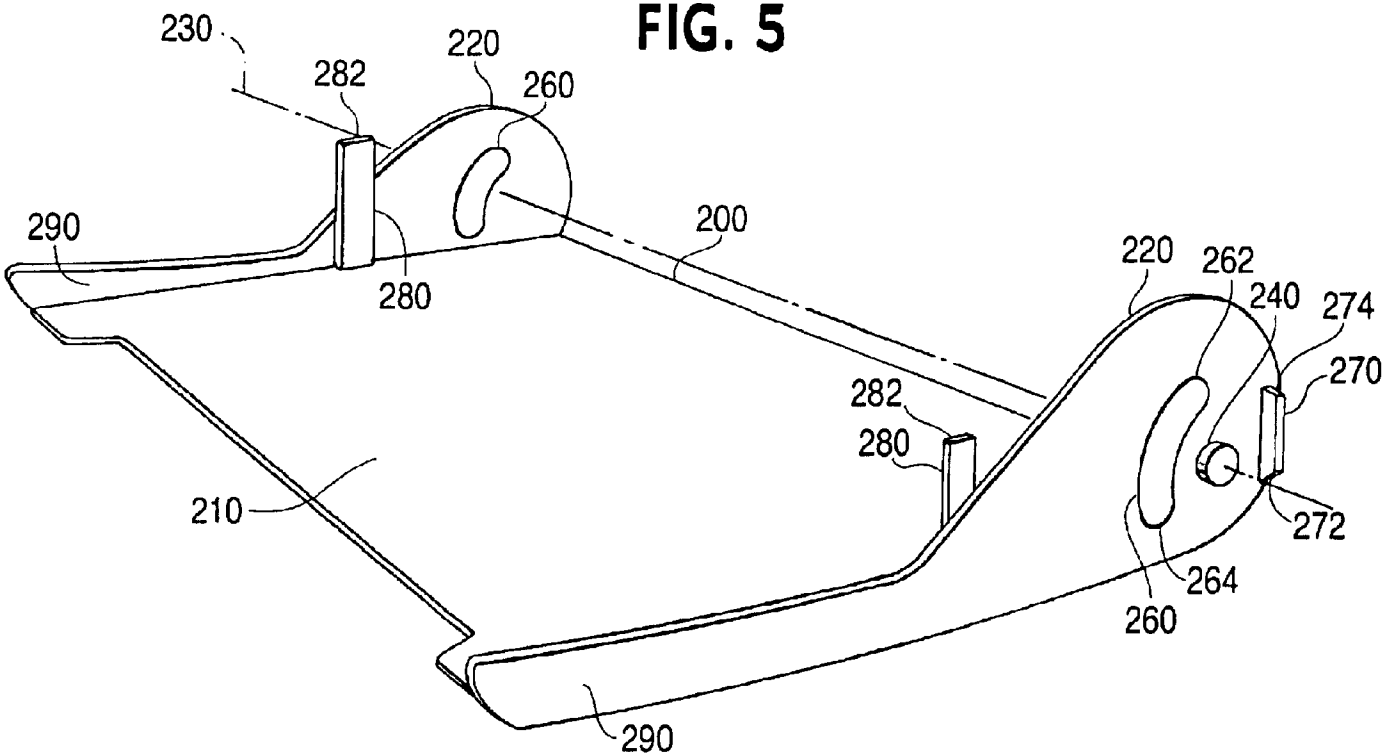
FIG. 5 shows a tray of the printer of FIG. 1

FIG. 5, which illustrates the input tray 200 without the output tray 300, shows that in some embodiments of the present invention, an axis of rotation 230 of the input tray 200 is defined by rotation bosses 240 extending from the sides of the input tray 220, and can extend from the gussets 220. These rotation bosses 240 can be made as one piece with the input tray 200 and can extend from the sides of the input tray 200.

In the first embodiment of the invention, the rotation bosses 240 of the input tray fit into boss holes 430 (only one of which is shown in FIG. 4). Thus, when the rotation bosses 240 are inserted into boss holes 430, the input tray 200 can rotate from a closed position to an open position and visa-versa. As with the output tray, to facilitate insertion of the rotation bosses 240 into the rotation boss holes 430, the input tray 200 could also be provided with relief sections (not shown.) Alternatively or in addition to this, the input tray 200 could also flex. (This is the case with the output tray 300 as well.)

Some embodiments of the present invention utilize an input tray 200 that comprises a slotted gusset 220 on one or more sides of the input tray 200 which extend on a plane normal to the axis of rotation 230 of the input tray. These slotted gussets 220 can provide additional strength and flexural rigidity to the input tray 200.

In an embodiment of the invention, one or more of the slotted gussets 220 have a detent rib 270 extending from the gussets 220. In an embodiment of the invention, the detent rib 270 extends away from the input tray 200 from the side of the gusset 220 in the direction of the axis of rotation 230. In other embodiments, the detent rib 270 could extend inward and/or could extend normal to the axis of rotation 230.

The detent rib 270 can be used to lock the input tray 220 in the closed position, where "lock" is defined as providing a configuration where the input tray 200 will not move from the closed position except as a result of a force in excess of a force imparted on the mass of the input tray 200 as a result of gravity and/or the force imparted by other components of the printer 100. That is, by way of exemplary scenario, the input tray 200 would not rotate or at least not substantially rotate from the closed position in the open direction unless a user imparted an opening force on the input tray (either directly or indirectly) sufficient to move the input tray 200 in a direction towards the open position.

In one embodiment of the present invention, this locking is obtained by alternating interference of the detent rib 270 with a rib 440 on the printer housing 400 during rotation of the input tray 200 to or from the closed position, where "interference" is defined as a state of the material where elastic or substantial elastic deformation with minor plastic deformation has occurred in either the input tray 200 or the printer housing 400 as a result of contact between the detent rib 270 and the rib 440 of the printer housing, the contact being the result of the desire (due to elastic memory of a material) of either the detent rib 270 and/or the rib 440 to occupy the same space at the same time due to the configuration of the printer 100. By way of exemplary embodiment, when the input tray 200 is rotated in the direction of opening and/or closing, the interference could be a result of elastic deformation in at least one of the gusset 220 and a portion of the printer housing 400 that supports the rib on the printer housing.

In some embodiments of the present invention, the printer housing 400 includes one or more guide components 450 that interfere (consistent with the definition above) with one or more of the gussets 220 when the input tray is rotated in the closed and/or opened direction to plastically deform one or more of the gussets 220 and/or one or more of the components of the housing 400 so that one or more of the detent ribs 270 is pushed below (discussed in greater detail below) the rib 440 on the printer housing 400 to lock the input tray 200 in the closed position. That is, the guide component 450 can aid in the elastic deformation of the gussets 220 to enhance the locking of the input tray 200. In some embodiments of the invention, the guide components 450 limit the elastic deformation of the gussets 220; the bulk of the elastic deformation occurring in the components of the printer housing 400. In other embodiments, the guide components 450 modify the deformation of the gussets 220 (e.g. increase the deformation).

Figure 6:
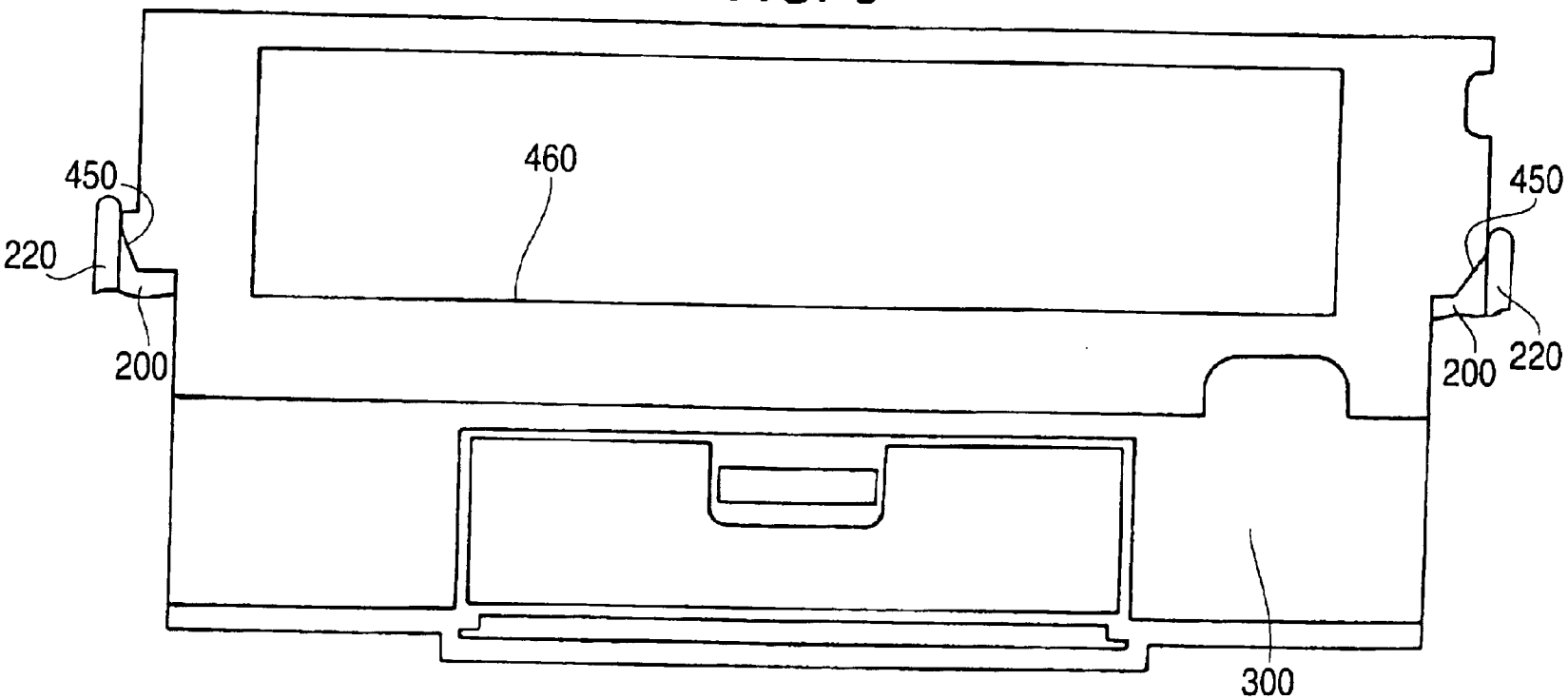
FIG. 6 shows the interior of the printer of FIG. 1
Figure 7:
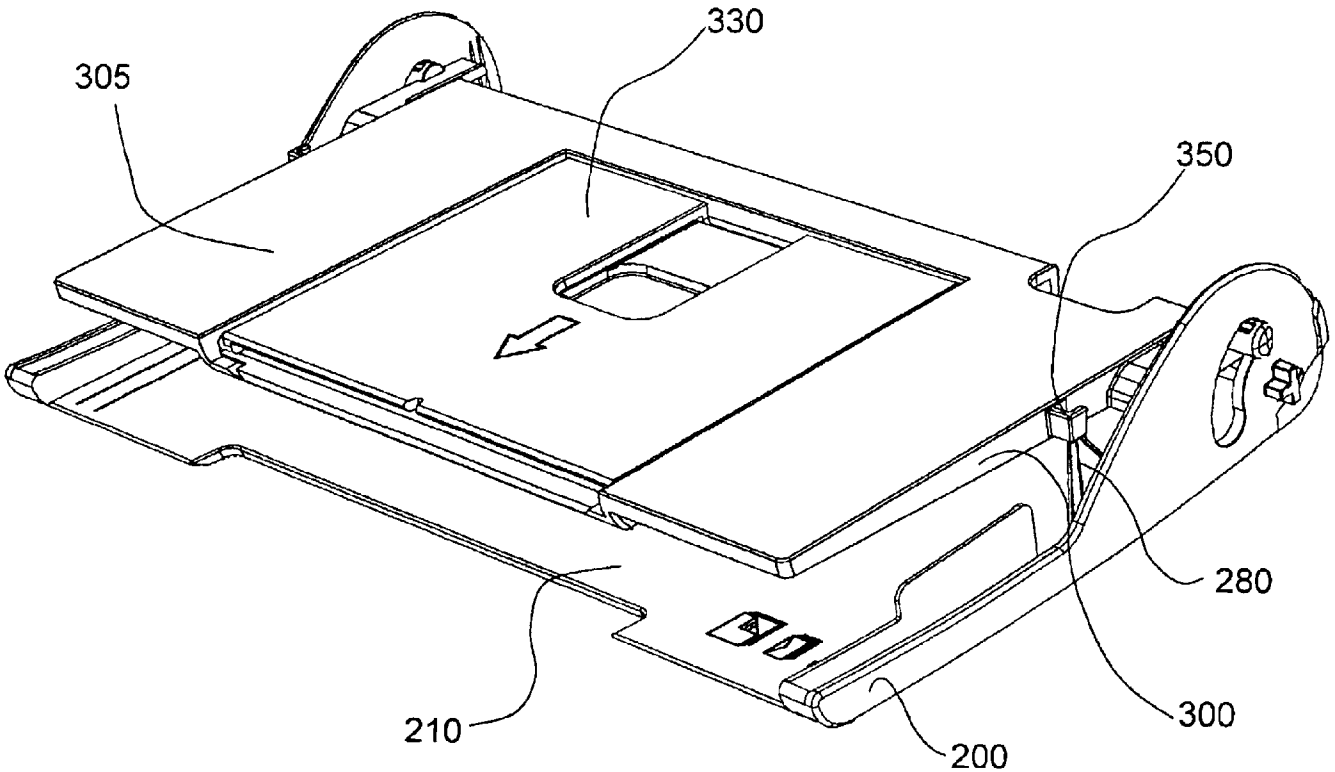
FIG. 7 shows the trays of the printer of FIG. 1 in the open position.
Figure 8:
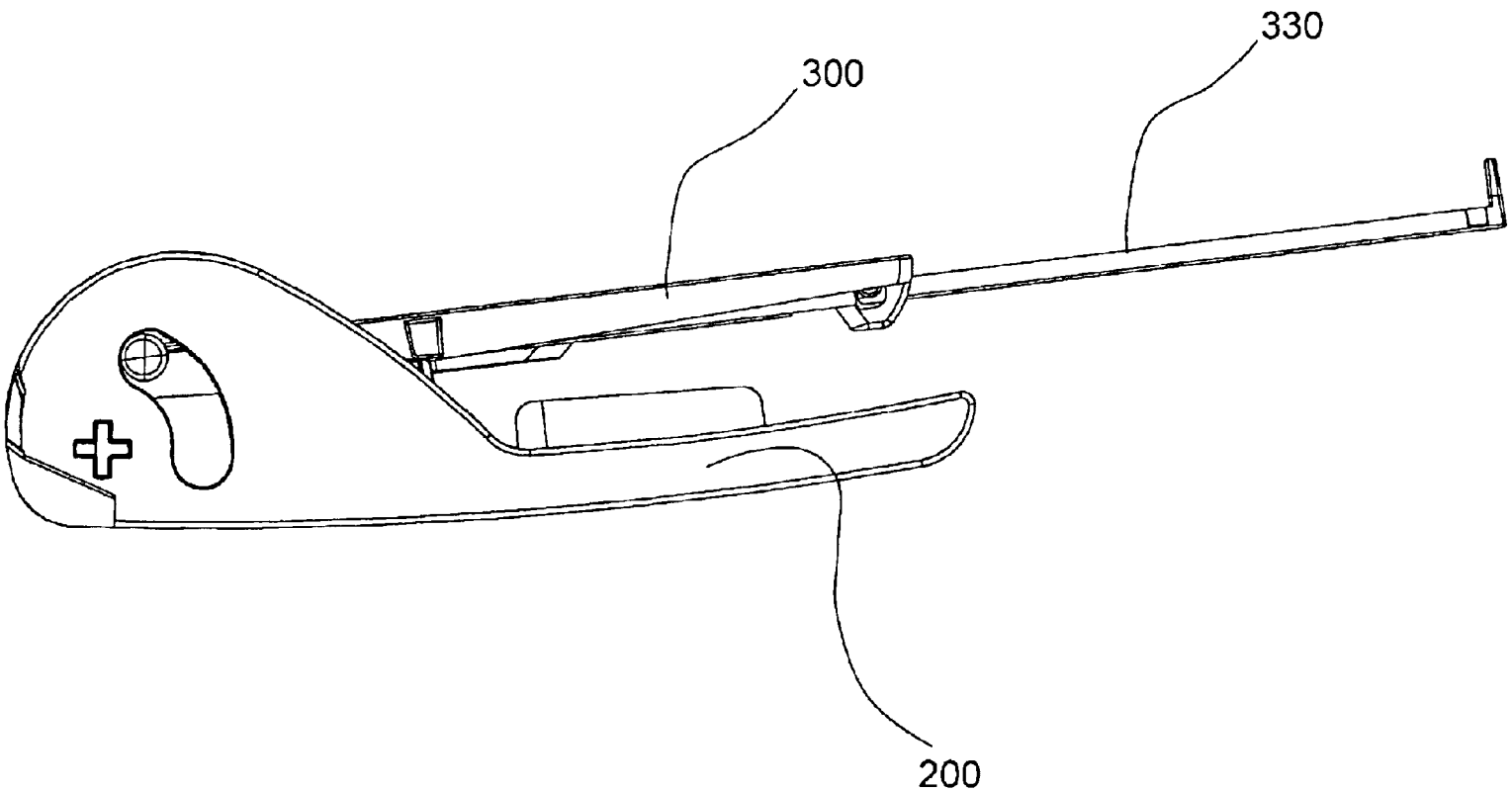
FIG. 8 shows a side view of the trays of the printer of FIG. 1 in the open position with the output stop extended.
Figure 9:
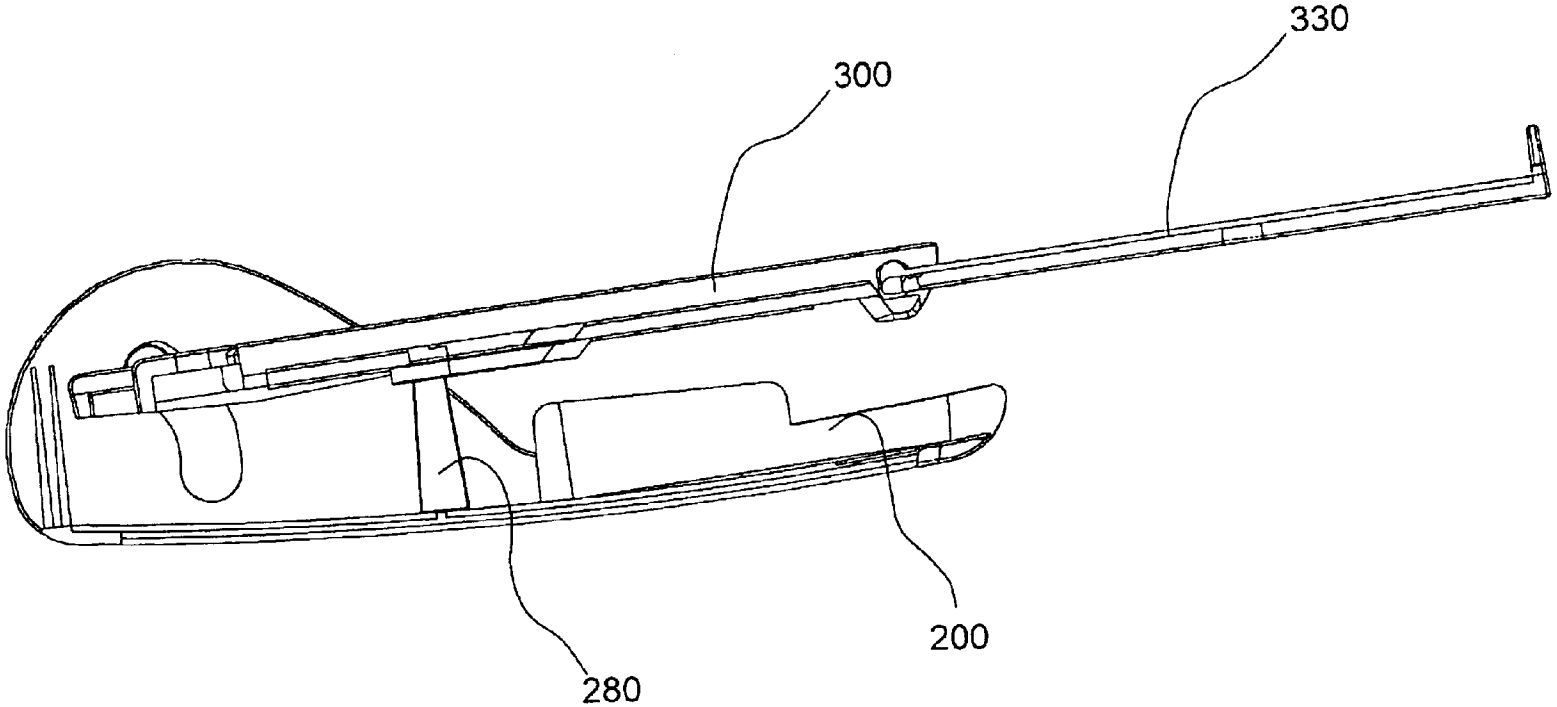
FIG. 9 shows a cross-sectional side view of the trays of the printer of FIG. 1 in the open position with the output stop extended.

In an embodiment of the invention, one or more guide components 450 are part of a spacer 460 that extend across or substantially across the cavity into which the trays close. FIG. 6 shows the spacer 460 according to one exemplary embodiment of the present invention as seen when looking downward in relationship to the input tray 300 and the output tray 200 (with the gussets 220) in the closed position.

The function of one embodiment of the present invention as it relates to the detent rib 270 and the rib 440 during opening and closing will now be discussed by way of exemplary scenario. Starting from the closed position of the input tray 200 of the embodiment shown in FIG. 5, the detent rib 270 is positioned below the rib 440. In this configuration of one embodiment of the invention, the input tray 200 would not be able to rotate in the open direction without an exterior force being applied to the input tray 200, as the canted end 274 of the detent rib 270 would be contacting the rib 440 and the material properties of these components would be such that they would not deform a significant amount to permit anything more than minor rotation of the input tray 200. Owing to the ability of at least one of the components of the tray 200 and the printer housing 400 to elastically or substantially elastically deform, one or both of the rib 440 and the detent rib 270 is pushed out of the way of the other as a significant rotating force is applied to the input tray 200, thus creating an interference between the rib 440 and the detent rib 270. While this interference continues, the input tray 200 is inhibited and/or prevented from substantially rotating towards the open position due to the friction forces between the rib 440 and the detent rib 270. Once the detent rib 270 clears the rib 440 so that there is no longer interference between the two components, the input tray 200 is free to rotate to the open position. In some embodiments of the invention, canted end 272 of detent rib 270 remains in contact with the rib 440 to inhibit rotation in the closed direction.

One or more of the gussets 220 of the present invention can have a slot 260. The slots 260 of one embodiment form a semi-circle with a center point substantially aligned with the axis of rotation 230. However, other embodiments of the present invention can utilize slots 260 of other shapes, such as by way of example, a rectangular shape, a triangular shape, an oval shape, etc. This is because in some embodiments of the invention, the slots 260 are for providing clearance for the rotation boss 340 of the output tray and/or for providing a rotation stop for the input tray 200, as can be seen in FIG. 3. That is, in some embodiments of the present invention, where the axis of rotation 335 of the output tray passes through the gussets 220 of the input tray 200, the gussets 220 can surround the rotation bosses 340 of the output tray 300. In such configurations, one or both ends 262 and 264 of the slots 260 can contact the rotation bosses of 340 when the input tray 200 is in the open position or in the closed position, respectively, thus preventing further rotation of the input tray 200. Thus, in some embodiments of the invention, the slots 260 can be of substantially any shape or configuration providing that the slots allow for clearance of the rotation boss 340 of the output tray 200 with respect to the flanges 220 and/or provide structure that serves to limit rotation of the input tray 200.

As can be apparent from the above discussion, in embodiments of the invention where the end 262 of the slots 260 contact the rotation boss 340 of the output tray 300, this contact can be used to define the open position of the input tray 200 and/or the angle of the input tray 200 relative to the rest of the printer when the input tray 200 is at the open position.

In an embodiment of the invention, the input tray 200 can be provided with one or more rotation stops 280 that contact the output tray 300 when the input tray 200 is in the open position to limit the rotation of the output tray and/or define the angle of the output tray 300 at the open position when the input tray 200 is in the open position. By way of example, when the input tray 200 is at the open position, the output tray 300, which could be rotated to its open position with the input tray 200, could come to rest on the ends 282 of the rotation stops 280. Rotation stop surfaces 350 could be provided on the output tray 300 that, in an exemplary embodiment, extends from the side of the output tray 300, around which could be provided open space so that when the input tray 200 and the output tray 300 are rotated in the closed position, the ends 282 of the rotation stops 280 slide from the stop surfaces 350 and/or from contacting the stop surfaces 350, thus permitting the output tray 300 to be nested in the input tray and/or to permit the output tray 300 to be positioned inboard of the input tray 200 at the closed position.

Figure 12:
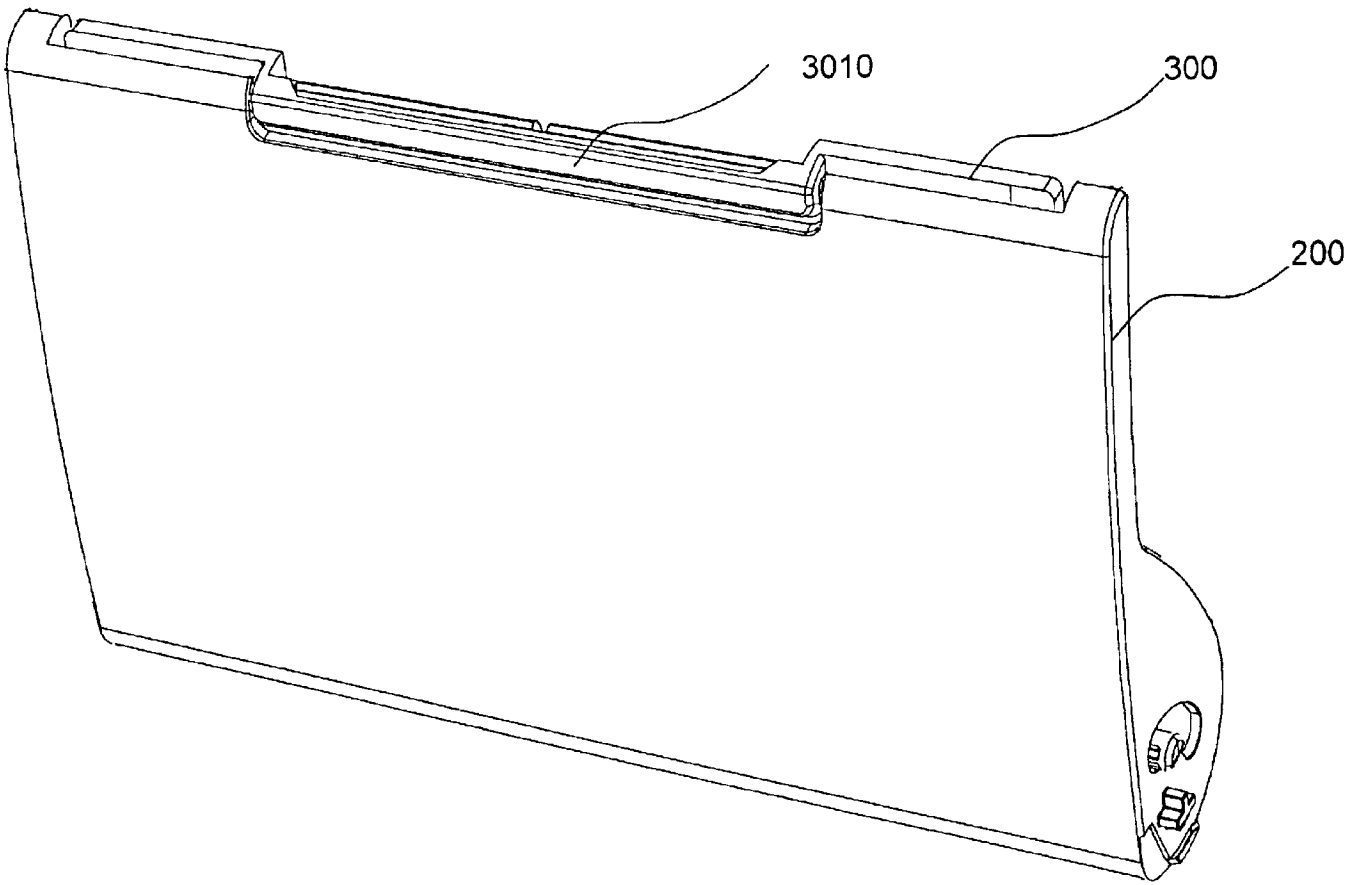
FIG. 12 shows another view of the trays of FIG. 1.

As noted above, some embodiments of the present invention comprise an output media stop 330 that extends from the output tray 300. This output media stop 330 can prevent or lessen the chances that output media will fall from the output tray during rapid printing operations. In some embodiments of the present invention, the output media stop 330 is hinged with a hinge 3030 so that the output media stop 330 can rotate in the counter clockwise direction (with respect to the orientation shown in FIG. 8) so that the output media stop 330 folds into the output tray 300. In one embodiment of the invention, the output media stop 330 is folded so that it drops prominently below the surface 305 of the output tray 300, as shown in FIG. 11. In other embodiments, a hinged portion 3010 of the output tray forms a handle that extends through the input tray 200 so that a user can rotate the trays from the closed position to the open position, as can be seen in FIGS. 12 and 13.

In another embodiment of the present invention, there is a method of using a printer according to one or more of the embodiments described above. In a first embodiment, the method comprises obtaining a printer comprising a full input tray including an input print media support surface and a full output tray including an output print media support surface. The full input tray and the full output tray can be in the open position or can be in the closed position when the printer is obtained. The method can further include moving the full input tray and the full output tray to a closed position so that at least one of the trays form part of an exterior side of the printer that is substantially contoured with the housing of the printer when the trays are in a closed position so that the input print media support surface or the output print media support surface is positioned outboard of the other when the full input tray and the full output tray are in the closed position. In another method embodiment, the full input tray forms part of the exterior side of the printer substantially contoured with the housing of the printer when the trays are in the closed position, and the input print media support surface is positioned outboard of the output print media support surface when the full input tray and the full output tray are in the closed position.

In yet another embodiment of the present invention, there is a method of using a printer which includes obtaining a printer having a full input tray including an input print media support surface and an output tray that can but does not have to be a full output tray. The output tray does include an output print media support surface separate from the input print media support surface of the input tray. The full input tray and the output tray can be in the open position or can be in the closed position when the printer is obtained. The method further includes moving the full input tray and the output tray to a closed position so that one of the trays nests in the other tray when the full input tray and the output tray are in the closed position. In another embodiment of the just discussed method, the output tray nests in the full input tray when the full input tray and the output tray are in the closed position, the full input tray and the output tray being rotatable from the open position to the closed position.

It is noted that in some embodiments of the invention, the printer according to the present is a multi-function printer and/or an "All-in-One Printer," as they are sometimes referred to. The present invention can be practiced with a printer that has, by way of example and not by limitation, Print/Fax/Scan/Copy capability. In other embodiments, the printer has one or more of a print, fax, scan and copy capability.

In another embodiment of the invention, the input tray 200 and/or the output tray 300 forms a dust proof barrier against substantial dust intrusion into the interior of the printer 100, at least in regard to the portions of the printer housing 400 that interface with the input tray 200 and/or output tray 300.

The foregoing description of various embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated.

What is claimed is:

1. A printer comprising:

an input tray including an input print media support surface; and an output tray including an output print media support surface; wherein at least one of the trays form part of an exterior side of the printer substantially contoured with a housing of the printer when the trays are in a closed position, and wherein the print media support surface of one of the trays is positioned outboard of the print media support surface of the other tray when the input tray and the output tray are in the closed position; wherein the input tray is configured to prevent input print media in the input tray that has not been circulated through the printer from contacting output print media in the output tray that has been circulated through the printer; wherein the output tray is configured to prevent output print media in the output tray that has been circulated through the printer from contacting input print media in the input tray that has not been circulated through the printer, and wherein one of the output tray and the input tray nests inside one of the other of the output tray and the input tray when the input tray and the output tray are in the closed position.

2. The printer of claim 1, wherein the input tray and the output tray are rotatable from the closed position to a open position and from the open position to the closed position.

3. The printer of claim 2, wherein the input tray forms part of an exterior side of the printer substantially contoured with a housing of the printer when the trays are in a closed position, and wherein the input print media support surface of the input tray is positioned outboard of the output print media support surface of the output tray when the input tray and the output tray are in the closed position.

4. The printer of claim 3, wherein the input print media support surface of the input tray is positioned below the output tray when the input tray and the output tray are in a open position.

5. The printer of claim 3, wherein the output tray sits about 20 mm above the input tray when both trays are in the open position.

6. The printer of claim 3, wherein the input tray is of one-piece configuration.

7. The printer of claim 1, wherein the input tray is rotatable about a first axis of rotation from the closed position to the open position and from the open position to the closed position, and wherein the output tray is rotatable about a second axis of rotation from the closed position to the open position and from the open position to the closed position.

8. The printer of claim 1, wherein the first axis of rotation is separate from the second axis of rotation.

9. A printer comprising:

an input tray including an input print media support surface; and an output tray including an output print media support surface; wherein at least one of the trays form part of an exterior side of the printer substantially contoured with a housing of the printer when the trays are in a closed position, and wherein the print media support surface of one of the trays is positioned outboard of the print media support surface of the other tray when the input tray and the output tray are in the closed position; wherein the input tray is configured to prevent input print media in the input tray that has not been circulated through the printer from contacting output print media in the output tray that has been circulated through the printer; wherein the output tray is configured to prevent output print media in the output tray that has been circulated through the printer from contacting input print media in the input tray that has not been circulated through the printer, wherein the input tray and the output tray are rotatable from the closed position to an open position and from the open position to the closed position; wherein the input tray forms part of an exterior side of the printer substantially contoured with a housing of the printer when the trays are in a closed position; wherein the input print media support surface of the input tray is positioned outboard of the output print media support surface of the output tray when the input tray and the output tray are in the closed position; and wherein the input tray comprises a slotted gusset on at least one side of the input tray, the gusset extending on a plane normal to an axis of rotation of the input tray, and wherein a rotation boss of the output tray extends through a slot in the slotted gusset.

10. The printer of claim 9, wherein the input tray comprises slotted gussets on two sides of the input tray, the slotted gussets extending on a plane normal to an axis of rotation of the input tray, and wherein rotation bosses of the output tray extends through a slot in each of the gussets.

11. The printer of claim 9, wherein an end of the slot of the slotted gusset contacts the rotation boss of the output tray when the input tray is rotated to the open position to limit the rotation of the input tray.

12. The printer of claim 11, wherein an end of the slot of the slotted gusset contacts the rotation boss of the output tray when the input tray is rotated to the open position to define the angle of the input tray when the input tray is at the open position.

13. The printer of claim 9, wherein the slotted gusset has a detent rib extending from the slotted gusset to lock the input tray in the closed position.

14. The printer of claim 13, wherein the detent rib of the slotted gusset interferes with a rib on the housing when the input tray is rotated in the direction of the open position from the closed position, the interference being a result of elastic deformation in at least one of the slotted gusset and a portion of the printer housing that supports the rib on the printer housing.

15. The printer of claim 14, wherein the detent rib does not interfere with the rib on the housing when the input tray is in the closed position and when the input tray is in the open position.

16. The printer of claim 13, wherein the housing includes a guide component that interferes with the slotted gusset when the input tray is rotated in the direction of the closed position from the open position to elastically deform the slotted gusset so that the detent rib is pushed behind the rib on the housing to lock the input tray in the closed position.

17. A printer comprising:

an input tray including an input print media support surface; and an output tray including an output print media support surface; wherein at least one of the trays form part of an exterior side of the printer substantially contoured with a housing of the printer when the trays are in a closed position, and wherein the print media support surface of one of the trays is positioned outboard of the print media support surface of the other tray when the input tray and the output tray are in the closed position; wherein the input tray is configured to prevent input print media in the input tray that has not been circulated through the printer from contacting output print media in the output tray that has been circulated through the printer; wherein the output tray is configured to prevent output print media in the output tray that has been circulated through the printer from contacting input print media in the input tray that has not been circulated through the printer, wherein the input tray and the output tray are rotatable from the closed position to a open position and from the open position to the closed position; wherein the input tray forms part of an exterior side of the printer substantially contoured with a housing of the printer when the trays are in a closed position; wherein the input print media support surface of the input tray is positioned outboard of the output print media support surface of the output tray when the input tray and the output tray are in the closed position; and wherein the input tray includes a rotation stop that contacts the output tray when the input tray is in the open position to limit the rotation of the output tray.

18. The printer of claim 17, wherein the rotation stop defines the angle of the output tray in the open position when the input tray is in the open position.

19. The printer of claim 18, wherein the angle of the output tray when the output tray is in the open position is defined by the angle of the input tray when the input tray is in the open position.

20. The printer of claim 17, wherein the rotation stop contacts a rotation stop surface on the output tray, and wherein rotation of the input tray and the output tray from the open position causes the rotation stop to be positioned in an area below the stop surface.

21. The printer of claim 3, wherein the output tray includes an output media stop that is extendable and retractable.

22. The printer of claim 3, wherein the output tray nests inside the input tray when the input tray is in the closed position.

23. A printer comprising:

an input tray including an input print media support surface; and an output tray including an output print media support surface; wherein at least one of the trays form part of an exterior side of the printer substantially contoured with a housing of the printer when the trays are in a closed position, and wherein the print media support surface of one of the trays is positioned outboard of the print media support surface of the other tray when the input tray and the output tray are in the closed position; wherein the input tray is configured to prevent input print media in the input tray that has not been circulated through the printer from contacting output print media in the output tray that has been circulated through the printer; wherein the output tray is configured to prevent output print media in the output tray that has been circulated through the printer from contacting input print media in the input tray that has not been circulated through the printer, wherein the input tray and the output tray are rotatable from the closed position to an open position and from the open position to the closed position; wherein the input tray forms part of an exterior side of the printer substantially contoured with a housing of the printer when the trays are in a closed position; wherein the input print media support surface of the input tray is positioned outboard of the output print media support surface of the output tray when the input tray and the output tray are in the closed position; and wherein a substantial portion of the output tray nests inside the input tray when the input tray is in the closed position.

24. The printer of claim 3, wherein the input tray and the output tray elastically deform to permit rotation bosses on the input tray and the output tray to snap into respective receptacles of the printer housing.

25. The printer of claim 21, wherein the output media stop hingedly rotates to be flush with or below the output print media support surface of the output tray.

26. A printer, comprising:

an input tray including a input print media support surface; and an output tray including an output print media support surface separate from the input print media support surface of the input tray; wherein one of the output tray and the input tray nests inside one of the other of the output tray and the input tray when the input tray and the output tray are in the closed position; and wherein the input tray is configured to prevent input print media in the input tray that has not been circulated through the printer from contacting output print media in the output tray that has been circulated through the printer.

27. The printer of claim 26, wherein the output tray nests in the input tray when the input tray and the output tray are in a closed position.

28. The printer of claim 27, wherein a portion of the output tray extends past a plane formed by the input print media support surface of the input tray when the output tray nests in the input tray.

29. The printer of claim 27, wherein the input tray comprises support walls extending from the input print media support surface of the input tray along the sides of the input tray, and wherein a substantial portion of the output print media support surface of the output tray lies inside an extrapolated volume formed by the input print media support surface of the input tray and the support walls of the input tray.

30. The printer of claim 27, wherein the support walls of the input tray substantially extend past sides of the output tray when the input tray and the output tray are in a closed position.

31. The printer of claim 26, wherein the output tray nests in the input tray when the input tray and the output tray are in a closed position, and wherein the input tray and the output tray are rotatable from the open position to the closed position.

32. The printer of claim 31, wherein a thickness of the input tray and the output tray is about the same as the thickness of the input tray when the output tray nests in the input tray.

33. The printer of claim 31, wherein the input print media support surface of the input tray is positioned below the output tray when the input tray and the output tray are in a open position.

34. The printer of claim 31, wherein the output tray sits about 20 mm above the input tray.

35. The printer of claim 31, wherein the input tray is of one-piece configuration.

36. The printer of claim 35, wherein the input tray comprises a slotted gusset on at least one side of the input tray, the slotted gusset extending on a plane normal to an axis of rotation of the input tray, and wherein a rotation boss of the output tray extends through a slot in the slotted gusset.

37. The printer of claim 31, wherein the input tray comprises slotted gussets located on two sides of the input tray, the slotted gussets extending on a plane normal to an axis of rotation of the input tray and wherein rotation bosses of the output tray extends through a slot in each of the slotted gussets.

38. The printer of claim 37, wherein an end of the slot of the slotted gusset contacts the rotation boss of the output tray when the input tray is rotated to the open position to limit the rotation of the input tray.

39. The printer of claim 38, wherein an end of the slot of the slotted gusset contacts the rotation boss of the output tray when the input tray is rotated to the open position to define the angle of the input tray when the input tray is at the open position.

40. The printer of claim 36, wherein the slotted gusset has a detent rib extending from the slotted gusset to lock the input tray in the closed position.

41. The printer of claim 40, wherein the detent rib of the slotted gusset interferes with a rib on a housing when the input tray is rotated in the direction of the open position from the closed position, the interference being a result of elastic deformation in at least one of the slotted gusset and a portion of the printer housing that supports the rib on the printer housing.

42. The printer of claim 41, wherein the detent rib does not interfere with the rib on the housing when the input tray is in the closed position and when the input tray is in the open position.

43. The printer of claim 40, wherein the housing includes a guide component that interferes with the gusset when the input tray is rotated in the direction of the closed position from the open position to elastically deform the slotted gusset so that the detent rib is pushed behind the rib on the housing to lock the input tray in the closed position.

44. The printer of claim 31, wherein the input tray includes a rotation stop that contacts the output tray when the input tray is in the open position to limit the rotation of the output tray.

45. The printer of claim 44, wherein the rotation stop defines the angle of the output tray when the input tray is in the open position.

46. The printer of claim 45, wherein the angle of the output tray when the output tray is in the open position is defined by the angle of the input tray when the input tray is in the open position.

47. The printer of claim 44, wherein the rotation stop contacts a rotation stop surface on the output tray, and wherein rotation of the input tray and the output tray from the open position causes the rotation stop to be positioned in an area below the stop surface.

48. The printer of claim 31, wherein the output tray includes a tray extension that is extendable and retractable.

49. The printer of claim 48, wherein the tray extension rotates from a stowed position in the output tray to an in-use position.

50. The printer of claim 48, wherein the tray extension telescopes outward from under the print media support surface of the output tray to an in-use position.

51. The printer of claim 31, wherein the input tray and the output tray elastically deform to permit rotation bosses on the input tray and the output tray to snap into respective receptacles of a printer housing.

52. The printer of claim 31, wherein the input tray forms part of an exterior side of the printer substantially contoured with a housing of the printer.

53. The printer of claim 28, wherein the output tray is a output tray.

54. The printer of claim 27, wherein the printer has Print, Fax, Scan, and Copy capability.

55. A printer, comprising:

a means for supporting input print media; and a means for supporting output print media; wherein one of the means for supporting input print media and the means for supporting output print media nests within the other when in the closed position.

56. The printer of claim 55, wherein the means for supporting input print media and the means for supporting output print media are rotatable about distinct axes between open and closed positions.

* * * * *